US010934746B2

(12) United States Patent
Debroucke et al.

(10) Patent No.: US 10,934,746 B2
(45) Date of Patent: Mar. 2, 2021

(54) LOCK FOR A MOTOR VEHICLE DOOR LEAF

(71) Applicant: U-SHIN FRANCE, Creteil (FR)

(72) Inventors: François Debroucke, Creteil (FR); Laurent Duriez, Creteil (FR); Cédric Lamidon, Creteil (FR)

(73) Assignee: U-SHIN FRANCE, Creteil (FR)

( * ) Notice: Subject to any disclaimer, the term of this patent is extended or adjusted under 35 U.S.C. 154(b) by 672 days.

(21) Appl. No.: 15/537,078

(22) PCT Filed: Dec. 17, 2015

(86) PCT No.: PCT/EP2015/080169

§ 371 (c)(1),
(2) Date: Jun. 16, 2017

(87) PCT Pub. No.: WO2016/097111

PCT Pub. Date: Jun. 23, 2016

(65) Prior Publication Data

US 2017/0342748 A1 Nov. 30, 2017

(30) Foreign Application Priority Data

Dec. 18, 2014 (EP) ..... 14307094

(51) Int. Cl.
*E05B 77/06* (2014.01)
*E05B 77/08* (2014.01)
(Continued)

(52) U.S. Cl.
CPC ..... *E05B 77/06* (2013.01); *E05B 77/02* (2013.01); *E05B 77/04* (2013.01); *E05B 77/08* (2013.01);
(Continued)

(58) Field of Classification Search
CPC ..... E05B 77/06; E05B 77/04; E05B 77/08; E05B 77/36; E05B 77/38; E05B 77/02;
(Continued)

(56) References Cited

U.S. PATENT DOCUMENTS 7,699,366 B2 * 4/2010 Hanaki ..... E05B 79/20 292/216
9,243,429 B2 * 1/2016 Bendel ..... E05B 77/06
(Continued)

FOREIGN PATENT DOCUMENTS

DE 195 11 651 A1 10/1995
DE 10 2011 010815 A1 8/2012
EP 1 371 799 A2 12/2003

OTHER PUBLICATIONS

International Search Report issued in PCT/EP2015/080169 dated Mar. 22, 2016 (4 pages).
(Continued)

*Primary Examiner* — Christine M Mills
*Assistant Examiner* — Faria F Ahmad
(74) *Attorney, Agent, or Firm* — Burris Law, PLLC

(57) ABSTRACT

A lock (1) for a motor vehicle door, comprising: —an assembly of control means (7), each control means being mobile; —an assembly of opening levers (10A, 10B) of said door (2), each lever (10A, 10B) being intended to enable the opening of the door (2) by a control means (7) of the control means assembly, each lever (10A, 10B) comprising a cam (11A, 11B) which can rotate about an axis of rotation (8) and is fixed to said control means (7) in a fixation region (9) so as to be rotated during a movement of the control means (7); —a blocking means (12) configured to take an active blocking position, in which said blocking means (12) blocks an opening lever (10A), and a rest position in which said blocking means (12) authorises the movement of each opening lever (10A, 10B), —a spring-back blocking means
(Continued)

(14) configured to switch said blocking means (12) from the rest position to the active blocking position, and —a trigger means (16) configured to take a rest position in which said trigger means (16) blocks the blocking means (12) in the rest position thereof and an active unblocking position in which said trigger (16) releases said blocking means (12) so that said blocking means switches from the rest position to the active blocking position, —the blocking means (12) and one opening lever (10B) not blocked by the blocking means in the blocking position (10) interacting so as to convey the blocking means (12) from the active blocking position to the rest position when said non-blocked opening lever (10B) pivots in the opening direction of the door (2).

15 Claims, 4 Drawing Sheets

(51) Int. Cl.
*E05B 77/38* (2014.01)
*E05B 77/02* (2014.01)
*E05B 77/04* (2014.01)

(52) U.S. Cl.
CPC ..... *E05B 77/38* (2013.01); *Y10S 292/23* (2013.01); *Y10T 292/1043* (2015.04); *Y10T 292/1047* (2015.04); *Y10T 292/1051* (2015.04); *Y10T 292/1056* (2015.04); *Y10T 292/1082* (2015.04); *Y10T 292/1092* (2015.04); *Y10T 292/57* (2015.04)

(58) Field of Classification Search
CPC ..... Y10T 292/1043; Y10T 292/105; Y10T 292/1056; Y10T 292/57; Y10T 292/1082; Y10T 292/1092; Y10T 292/1047; Y10S 292/23
See application file for complete search history.

(56) References Cited

U.S. PATENT DOCUMENTS

| | | | | |
|---|---|---|---|---|
| 10,309,129 | B2 * | 6/2019 | Suholutskaja | E05B 77/06 |
| 10,577,837 | B2 * | 3/2020 | Debroucke | E05B 77/06 |
| 2006/0103143 | A1 * | 5/2006 | Belmond | E05B 81/06 292/201 |
| 2007/0085349 | A1 * | 4/2007 | Merideth | E05B 77/06 292/183 |
| 2014/0132008 | A1 * | 5/2014 | Bendel | E05B 85/26 292/92 |
| 2014/0291997 | A1 | 10/2014 | Hunt | |
| 2016/0237722 | A1 * | 8/2016 | Suholutskaja | E05B 77/06 |
| 2017/0114574 | A1 * | 4/2017 | Topfer | E05B 77/06 |
| 2018/0038137 | A1 * | 2/2018 | Damboiu | E05B 77/26 |
| 2018/0363336 | A1 * | 12/2018 | Weber | E05B 77/06 |
| 2019/0145133 | A1 * | 5/2019 | Graute | E05B 77/06 |

OTHER PUBLICATIONS

Written Opinion of the International Searching Authority issued in PCT/EP2015/080169 dated Mar. 22, 2016 (6 pages).

* cited by examiner

LOCK FOR A MOTOR VEHICLE DOOR LEAF

The present invention concerns a latch for a motor vehicle door leaf.

A motor vehicle latch is intended to be mounted on a motor vehicle door leaf and typically includes a bolt intended to pivot about a strike fastened on the structure of the motor vehicle in order to ensure the closure of the door leaf. The opening of the door leaf is carried out by a rotation of the bolt in the opposite direction. Under normal conditions of use, the rotation in the opposite direction, called « opening direction of the door leaf », is performed by the displacement of the outer handle which is connected to the latch by a control means which acts on an opening lever called « outer » opening lever in order to pivot said opening lever, which, in turn, releases the bolt via a hooking device in the desired direction. Said rotation in the opposite direction may also be made by the rotation of the inner handle which is connected to the latch by a control means which acts on an opening lever, called « inner » opening lever. The rotation of said inner opening lever generates the rotation of another lever called « intermediate » lever which pivots and releases in turn the bolt via a hooking device in the desired direction.

Here, the term « outer handle » means a handle disposed on the door leaf of the motor vehicle which can be actuated by a user located outside the passenger compartment of the motor vehicle.

Here, the term « inner handle » means a handle disposed on the door leaf of the motor vehicle which can be actuated by a user located inside the passenger compartment of the motor vehicle.

Here, the term « outer opening lever » means the lever allowing the opening the latch which is driven in displacement by the action of a user on the outer handle.

Here, the term « intermediate opening lever » means the lever allowing the opening the latch which is controlled by the displacement of the opening lever called « inner » opening lever, which is itself driven in displacement by the action of a user on the inner handle.

However, in case of a lateral shock, the inertial force exerted on the door leaf may exert a sufficient traction force on a control means and act on an opening lever to control the opening of the latch and therefore the release of the door leaf, in particular on the outer opening lever.

In order to avoid this, there are latches configured not to have movement of kinematics during a shock or to inhibit the effect of the movement.

Thus, blocking solutions of the kinematic chain by resistive effort are proposed, such as the springs, or by blocking. This last solution allows a better robustness of the latch vis-à-vis the different families of shock.

The latch blocking may be made by an external obstacle generating a deformation due to a temporary or permanent inertial movement, with a possibility of resetting to the post-shock state in this last case The blocking by an external obstacle is typically made by a system which intervenes by deformation of the door. If a deformation is greater than a threshold value, therefore there is an external obstacle which blocks the movement of the opening chain.

The blocking instruction typically comes from a deformation of the sheet metal of the vehicle. The deformation of this sheet metal will position an obstacle belonging either to the latch, or to the sheet metal workshop, facing the outer opening lever. Since the lever intervenes directly in the opening of the latch, said opening may not be done.

However, such a system requires an adaptation to the geometry of the door, a deformation of said door, an insensitivity to the movement of the handle and the impossibility of opening of the door after the shock.

There is the temporary blocking by inertial movement made by a system which reacts to an abnormal acceleration of the latch. If the value and the duration of the acceleration are greater than a threshold value, therefore a connecting rod is displaced to block the opening or to disengage the movement.

In these designs, a locking wedge with spring is typically hooked to the outer opening lever. An inertial effort displaces said wedge on the side during the movement of said lever. A chute receives the wedge and prevents it from redescending as long as the outer opening lever is activated. Since the outer opening lever is not able to be activated, there is no opening.

However, this system requires a good knowledge of the shock, in particular of the movement of the handle in case of shocks, a certain synchronization of the adjusting movements and a certain insensitivity to the movement of the outer opening lever.

An aim of the invention is to propose a latch for a motor vehicle which allows preventing the outer or inner opening under the effect of an inertial force, whether it is single or multiple, applied to the latch during a car accident, while allowing, once the inertial force becomes zero again, the reopening of the latch without having the drawbacks of the prior art.

To this end, the object of the invention is a latch for a motor vehicle door leaf including a latch for a motor vehicle door leaf including:

- a set of control means, each control means being movable;
- a set of opening levers of said door leaf, each lever being intended to allow the opening of the door leaf by a control means of the set of control means, each lever comprising a cam movable in rotation about an axis of rotation and fastened to said control means at a fastening zone so as to be driven in rotation during the displacement of the control means,
- a blocking means configured to take an active blocking position in which said blocking means blocks an opening lever and a rest position in which said blocking means authorizes the movement of each opening lever,
- an elastic return blocking means configured to switch said blocking
- a trigger means configured to take a rest position in which said trigger means blocks the blocking means in the rest position thereof and an active unblocking position in which said trigger releases said blocking means so that said blocking means switches from the rest position to the active blocking position,
- the blocking means and an opening lever not blocked by the blocking means in the blocking position cooperating so as to bring the blocking means from the active blocking position to the rest position when said non-blocked opening lever pivots towards the direction of the opening of the door leaf.

The latch of the present invention thus allows having an effective blocking of the door and preventing the opening of the latch for a movement of one of the opening levers. Said latch also has the advantage of being able to reset the blocking system to the initial position under the effect of a simple traction operation of the opening lever not intended to be blocked by the blocking means after the shock.

Such a blocking system is advantageously independent of the geometry of the door, of the movement of the handle and of the type of shock, does not generate a stress on the kinematic chain, does not require delicate adjustment and is independent of the geometrical constraints.

According to preferred embodiments, the latch for a motor vehicle according to the invention comprises one or several of the following features, taken separately or in combination:

- the blocking means and the opening lever intended not to be blocked cooperate by the contact with a protuberance belonging to the blocking means or to an opening lever on the cam of the opening lever intended not to be blocked;
- the blocking means and the opening lever intended not to be blocked cooperate by the contact with a protuberance belonging to a part distinct from the blocking means or from the opening levers;
- the elastic return blocking means includes a first end capable of coming under a stop belonging to the blocking means and a second end capable of being fastened on a fixed member of the latch;
- the blocking means includes an elastic lug abutting against a fixed member of the latch and intended to exert a return force on the blocking means when said blocking means is in the active blocking position;
- the trigger means is associated to an elastic return unblocking means configured to allow the switch of the trigger means from the rest position to the active unblocking position;
- the trigger means is movable in translation thanks to the elastic return means, such as a compression spring, fastened to the trigger means and to a fixed member of the latch;
- the trigger means includes a protuberance being substantially in or on a complementary notch present in the blocking means;
- the blocking means is disposed in the latch in the rest position such that at each rotation of the opening lever in the direction of the opening of the door leaf and when the blocking means is in the rest position, the blocking means and the opening lever come into contact;
- the cam of the opening lever intended to be blocked includes a hook-type protuberance, formed by a stop of a structure defining a reinforcement intended to receive a blocking means portion when said blocking means portion is in the active blocking position so as to block the movement of the opening lever intended to be blocked;
- the blocking means includes a ramp allowing the elastic return blocking means to return under the stop when said blocking means switches from the active blocking position to the rest position;
- the protuberance is configured to receive the end of the elastic return blocking means and to drive said end under the stop of the blocking means when the blocking means has been brought into the rest position;
- the blocking means includes at least one elastic arm configured to modify the length of the blocking means in order to allow disengaging the elastic return blocking means relative to the blocking means when the blocking means switches from the active blocking position to the rest position;
- the opening lever intended to be blocked is the outer opening lever intended to be driven by a control means controlled by a handle external to the motor vehicle and the opening lever intended not to be blocked is the intermediate opening lever intended to be driven by a control means controlled by a handle internal to the motor vehicle.

The object of the invention is also a motor vehicle including a door leaf and a latch intended to open and close said door leaf.

Other advantages and features will appear upon reading the description of the invention given by way of example, as well as in the appended figures in which.

Figure 2:
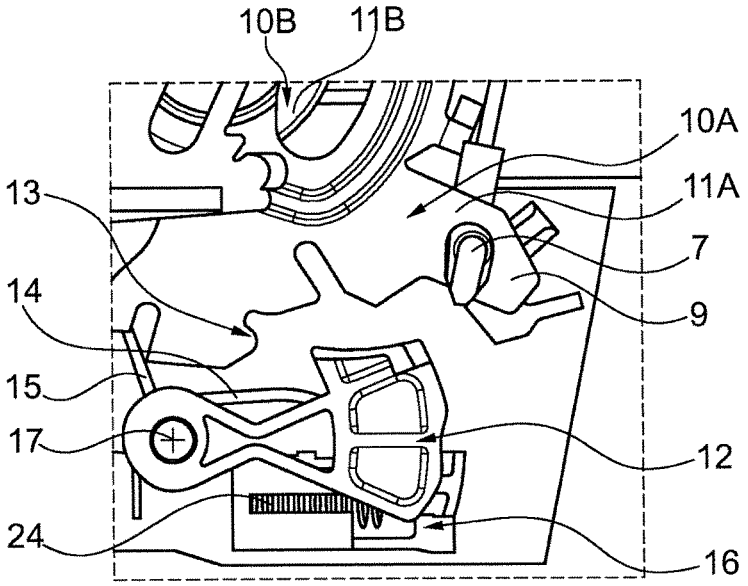
FIGS. 2 to 4 are front and perspective views of an embodiment of a latch according to the invention.
Figure 3:
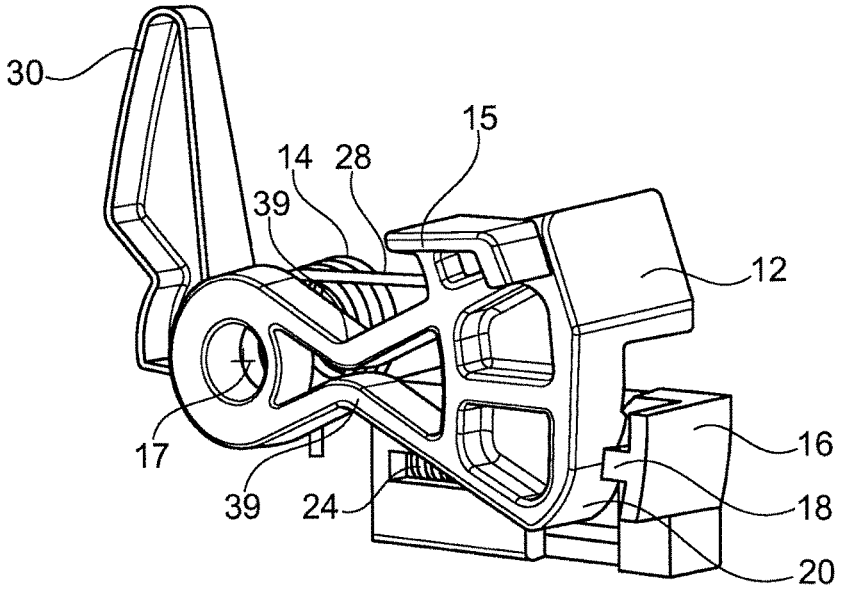
Figure 4:
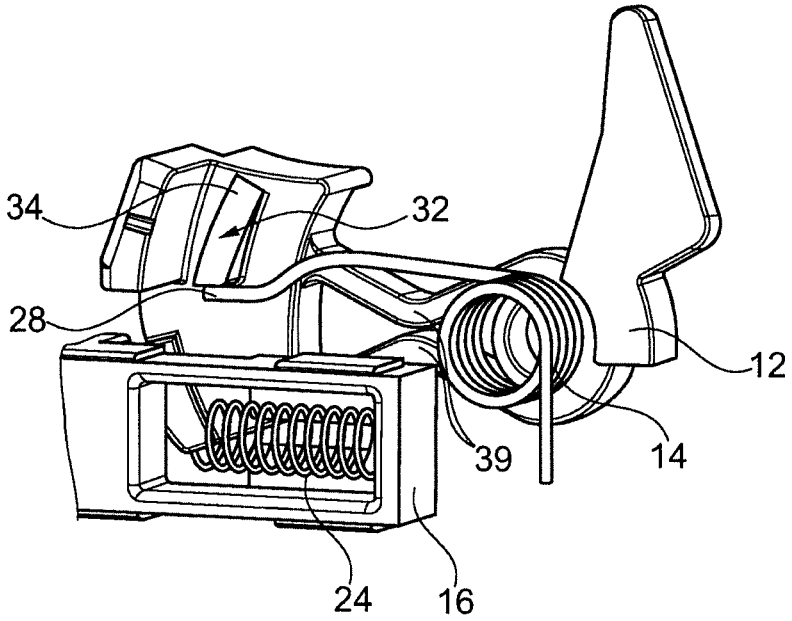

FIGS. 6*a* to 6*f* are front views of a variant of the embodiment of FIGS. 2 to 4 in operation.

The latch of the invention includes two types of opening lever: an inner opening lever and an outer opening lever. The outer opening lever is connected via a cable, such as the Bowden cable, or a rod to the outer handle. The inner opening lever is connected via another cable to the inner handle. Said inner opening lever is also connected via one or several member(s) to an intermediate opening lever which allows the opening of the latch.

Figure 1:
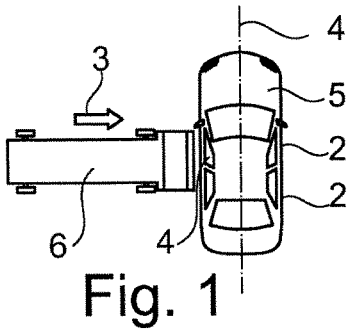
FIG. 1 is a partial top view of a vehicle subjected to a lateral shock.

As represented in FIG. 1, the latch of the invention 1 is adapted to open any type of door leaf of a motor vehicle, in particular a lateral door 2.

In this FIG. 1 there is illustrated an example of a lateral shock along a direction 3 substantially perpendicular to the main axis 4 of the motor vehicle 5. The shock may be generated by any kind of member, here a motor vehicle 6 is represented. Such a shock acts on the outer handle in the direction of the opening of said outer handle according to an oscillating movement comprising one or several phase(s) during which the rod or the cable is pulled, which is likely to thereby generate the opening of the latch.

As schematically represented in FIGS. 2 to 5, said latch 1 includes a blocking system comprising:

- a set of control means 7, each control means being movable;
- a set of opening levers 10A and 10B of said door leaf 2, each lever 10A, 10B being intended to allow the opening of the door leaf 2 by a control means 7 of the set of control means, each lever comprising a cam 11A and 11B movable in rotation about an axis of rotation 8 and fastened to said control means 10A and 10B at a fastening zone 9 so as to be driven in rotation during the displacement of the control means 10A and 10B;
- a blocking means 12 configured to take an active blocking position in which said blocking means 12 blocks an opening lever 10A and a rest position in which said blocking means 12 authorizes the movement of each opening lever 10A and 10B,
- an elastic return blocking means 14 configured to switch said blocking means 12 from the rest position to the active blocking position, and
- a trigger means 16 configured to take a rest position in which said trigger means 16 blocks the blocking means 12 in the rest position thereof and an active unblocking position in which said trigger 16 releases said blocking means 12 so that said blocking means switches from the rest position to the active blocking position,
- the blocking means 10 and an opening lever 10B not blocked by the blocking means in the blocking position cooperating so as to bring the blocking means 12 from the active blocking position to the rest position when said non-blocked opening lever 10B pivots towards the direction of the opening of the door leaf 2.

In the embodiment represented in the figures, the opening lever 10A is the outer opening lever connected to the outer handle of the door leaf 2 via the Bowden cable 7. The opening lever 10B is the intermediate opening lever connected directly or indirectly to the inner handle of the door leaf 2 via a cable or a rod (not represented).

It is possible to consider another configuration with the intermediate opening lever intended to be blocked and the outer opening lever intended not to be blocked.

In any case, when one of the outer or intermediate opening levers, is blocked by the blocking means, the latch cannot open under the effect of the shock.

As visible in FIG. 2, each lever 10A and 10B includes a cam 11A and 11B, respectively, movable in rotation about a rotation axis 8, when a traction is exerted on the control means, namely the Bowden cable 7 or the rod acting on the intermediate opening lever 10B.

In order to improve the return of the blocking means 12 from the blocking position to the rest position, the opening lever 10A may further include a drive means, such as a first stop (not represented) to accompany the blocking means 12 from the active position to the rest position if the outer opening lever 10A is driven by action on the outer handle towards the direction of the opening of the door leaf 2.

In a first variant of the solution represented in FIG. 2, the drive means may be supported by the cam 11A in the shape of at least one protuberance 13 which allows the switch of the blocking means 12 into the rest position. In a second variant illustrated in FIG. 5, it is the blocking means 12 which is itself provided with an elastic lug 12*a* in order to assist this switch. The elastic lug 12*a* is typically abutting against a fixed member 12*b* of the latch of the invention and intended to exert a return force on the blocking means 12 when said blocking means is in the active blocking position. The elastic lug 12*a* has the shape of a substantially thin blade having deformation features allowing exerting a return force on the blocking means 12 towards the rest position.

In both cases, the cam 11A may have a bearing surface capable of making contact with the blocking means 12 so as to drive said blocking means into the rest position and to reset the elastic return means 14.

The protuberance 13 of the cam 11A may have a hook-type shape formed by a stop of a structure defining a reinforcement intended to receive a portion 15 of a blocking means 12 when said blocking means portion is in the active blocking position so as to block the movement of the opening lever 10.

The trigger means 16 and the blocking means 12 may be each movable in rotation or in translation. Within the scope of the described examples, the trigger means 16 is movable in translation, in particular along an axis substantially collinear with the plane formed by the cams 11A and 11B. The blocking means 12 is movable in rotation along an axis of rotation 17 substantially collinear to the axis of rotation 8 of the cams 11A and 11B.

Any other combination is conceivable.

The trigger means 16 is accordingly configured so as to block any movement of the blocking means 12. For this purpose, the trigger means 16 may include a holding protuberance 18 coming substantially in or on a complementary notch 20 present in the blocking means 12. This geometry allows avoiding the manufacturing clearances of the blocking means and the triggering means. In the rest position of the trigger means 16 and the blocking means 12, the elastic return blocking means 14 exerts a permanent torque on the holding protuberance 18 which tends to raise the blocking means 12 towards the blocking position.

The trigger means may be made in the shape of a single part or of a multitude of parts.

The trigger means 16 may also be associated to an elastic return unblocking means of its own, such as a compression spring 24, which allows a movement in translation of said trigger means 16. The elastic return unblocking means 24 associated to the trigger means 16 is fastened on a fixed portion of the latch 1 of the invention. The assembly formed by the trigger means 16 and the associated elastic return means 24 are disposed so as to be moved as a result of the resulting inertial force of the lateral shock undergone by the latch 1 of the invention. In other words, in order to move the trigger means 16 and the blocking means 12, it is necessary that the inertial force in case of shock undergone by the door leaf is greater than the stiffness of the elastic return means 24.

Said elastic return unblocking means 24 thus allows said trigger means 16 to hold the blocking means 12 in the rest position. In case of shock along the direction 3, said elastic return unblocking means, such as the spring 24, is then compressed, driving the trigger means 16 and releasing the blocking means 12. The trigger means 16 then reaches the active unblocking position, thanks to the spring 24.

The blocking means 12 and an opening lever not blocked by the blocking means in the blocking position 10, as here the outer opening lever 10B cooperate so as to bring the blocking means 12 from the active blocking position to the rest position when said opening lever 10B pivots towards the direction of the opening of the door leaf 2.

Advantageously, the blocking means 12 and the opening lever intended not to be blocked, in particular the intermediate opening lever 10B, cooperate by the contact with a protuberance 30 belonging to the blocking means 12 on the cam 11B of the opening lever intended not to be blocked. In a variant, the protuberance 30 belongs to one of the opening levers 10A or 10B, in particular the intermediate opening lever 10B.

According to yet another variant, the protuberance 30 belongs to a member distinct from the blocking means 12 and the openings levers 10A and 10B. In this case, said distinct member may include an arm in order to relay the movement undergone by the protuberance 30 to the blocking means 12.

The protuberance 30 thus allows putting the blocking means 12 into the rest position from the blocking position by compressing the elastic return blocking means 14. In a variant exposed hereinafter, the opening lever 10A intended to be blocked may assist in resetting in the rest position by resetting itself said elastic return blocking means 14.

Thus, a portion of the protuberance 30 bears on the cam 11B which, when it pivots about its axis of rotation 8, pushes the protuberance 30 and thus the blocking means towards the rest position, namely to the holding position in the trigger 16.

The protuberance 30 may be made in one-piece part or not with the blocking means 12.

It is also possible that the cam 11B of the intermediate opening lever carries the protuberance 30 which bears on a surface of the blocking means configured to allow the driving of the blocking means from the blocking position to the rest position.

The blocking means 12 is also associated to the elastic return blocking means 14 which may be in the shape of one or several spring(s), in particular in the shape of a spiral spring. In this last case, the spiral spring has an axis of rotation substantially coincident with the axis of rotation of the blocking means 12. The elastic return blocking means 14 is configured so as to work by bringing the blocking means 12 from the rest position to the active blocking position in case of release of said blocking means 12 by the trigger means 16.

One of the opening levers, or even the two opening levers, may include a contact surface, in particular a stop (not represented), capable of receiving the end of the elastic return blocking means 14 and of driving said end so as to reset the elastic return means 14 in the working position. In the case where a single lever includes this stop, said lever may be the outer opening lever which allows resetting the elastic return blocking means 14 in compression after the outer handle is actuated.

Figure 5:
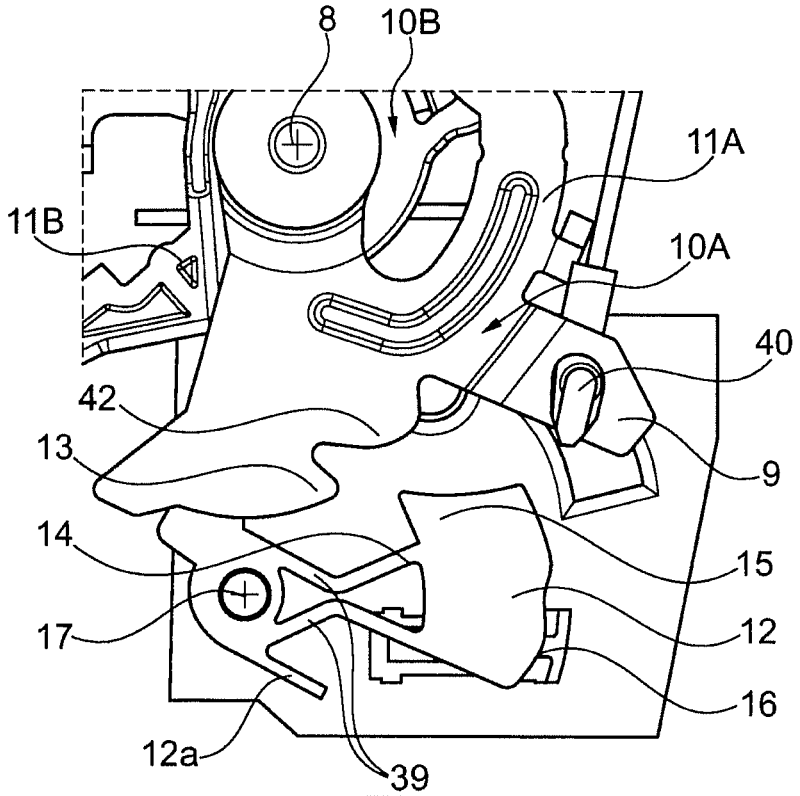
FIG. 5 is a partial schematic front view of a variant of the embodiment of FIGS. 2 to 4 comprising an elastic lug acting on the blocking means.

According to the embodiment of FIG. 5, the elastic blocking return means 14 includes an end 28 capable of coming under a stop 32 belonging to the blocking means 12.

The blocking means 12 may also have a ramp 34 formed on the stop 32 so as to allow the positioning of the end 28 under the stop 32 in the case where the elastic return means 14 is reset in compression by one of the levers.

The switch from the active blocking position to the rest position may thus be assisted under the effect of its own weight or assisted by the torque generated by the flexible lug 12*a*. The return of the blocking means 12 from the blocking position to the rest position may also be accompanied by the resetting of the elastic return blocking means 14. To this end, the blocking means 12 includes at least one elastic arm 39 configured to modify the length of the blocking means 12. Said elongation of the blocking means 12 allows releasing the elastic return blocking means 14 relative to the stop 32. The elastic return blocking means 14 then no longer exerts a torque on the blocking means 12. Said elongation of the elastic arm(s) may be carried out when the blocking means 12 switches from the active blocking position to the rest position, in particular when said blocking means undergoes a significant traction of the opening lever 10 higher than a door opening normal traction by a user.

Each elastic arm 39 has deformation features allowing regaining their original shape after the elongation in the blocking position of the blocking means 12. Consequently, in order to take the end 28 out of the elastic return blocking means, it is appropriate to exert a traction on the outer opening lever 10A greater than the stiffness corresponding to the sum of that of each elastic arm 39.

Thus, in the active blocking position, when the outer opening lever 10A pivots towards the opening direction, namely when a user acts on the cable or a rod driving said lever to open the door leaf 2, a pressure is exerted on the blocking means at the protuberance(s) of the cam 11A holding the elastic arm(s) 39. Since the length of the blocking means 12 is larger, the end 28 of the elastic return means is released from the stop 32. The resetting is therefore performed thanks to the stop 13 belonging to the opening lever 10 which puts said end 28 back under the stop 32 by passing through the ramp 34.

In all cases, the switch from the blocking position to the rest position is ensured by the cooperation between the blocking means 12, via the protuberance 30, and the intermediate opening lever 10B intended not to be blocked. The outer opening lever intended to be blocked only provides assistance in resetting in the rest position.

The blocking means 12 may be in permanent contact with the opening lever not intended to be blocked, here the intermediate opening lever 10B in the rest position, or else at a distance from said opening lever not intended to be blocked such that at each rotation of said lever in the direction of the opening of the door leaf, the elastic return means 14 is compressed. Thus, any blocking of the blocking means due to the aging of the latch is prevented. This permanent contact in the rest position, may advantageously be carried out by the protuberance 30 on the cam 11B of the opening lever.

The blocking means 12 may be made of a flexible material, such as an acetal resin, in order to authorize the deformation and the elongation. The trigger member will be made of the material which will allow reaching the desired mass for the inertial triggering.

The kinematics following a lateral shock, for example the shock along the direction 3, will now be described in more detail.

Figure 6A:
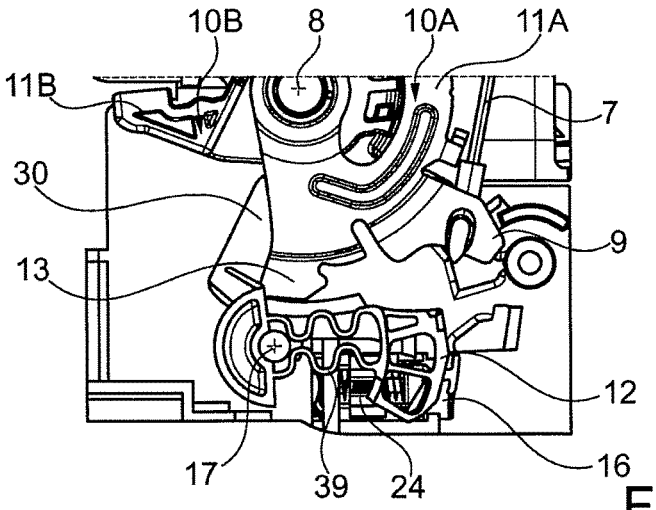

In the embodiment represented in FIG. 6*a*, the blocking means 12 and the trigger means 16 are both in the rest position. In this position, each control means, in particular the Bowden cable 7, may pivot the cam 11A or 11B and allow the opening of the latch 1 of the invention without hindering from the blocking means 12. As indicated above, according to an embodiment, it is possible to have a contact between the blocking means 12 and the cam 11B of the intermediate opening lever via the protuberance 30 so as to slightly compress without hindering the pivoting of the cam 11B in order to guarantee the proper operation of the blocking means 12 and to prevent any seizure of said blocking means.

In this position, the holding protuberance 18 of the triggering means is blocked in the notch 20.

The elastic return means 14 holds the blocking means 12 bearing against said trigger means 16.

Figure 6B:
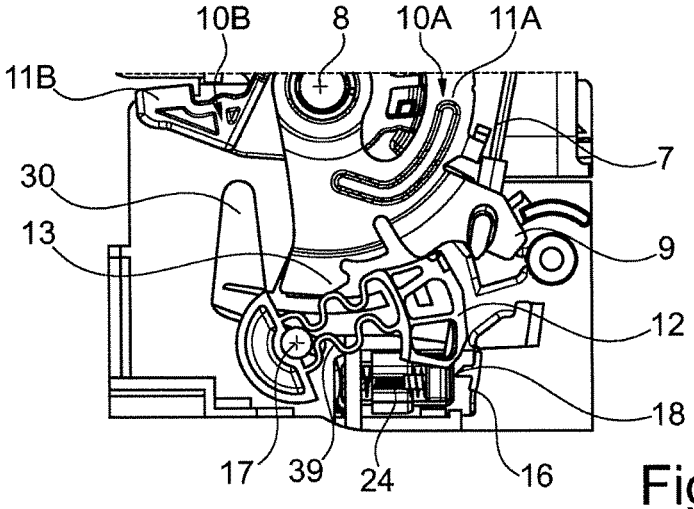

In the embodiment represented in FIG. 6*b*, the latch 1 of the invention undergoes a lateral shock along the direction 3. In this embodiment, under the effect of an inertial force greater than the stiffness of the elastic return means 24, the trigger member 16 is displaced and releases the blocking means 12 which comes into contact with the cam 11A of the opening lever intended to be blocked, here the outer opening lever 10A, by pivoting about its axis of rotation 17 under the effect of the elastic return means 14 thereof.

The protuberance 30 is spaced from the two opening levers 10A and 10B.

Each opening lever, in particular the outer opening lever 10A which is directly connected to the outer handle which undergoes the lateral shock 3, may be subjected to an acceleration. Said outer opening lever 10A may therefore start a rotation under the influence of a traction of the Bowden cable 7 and risk opening the door leaf 2.

Figure 6C:
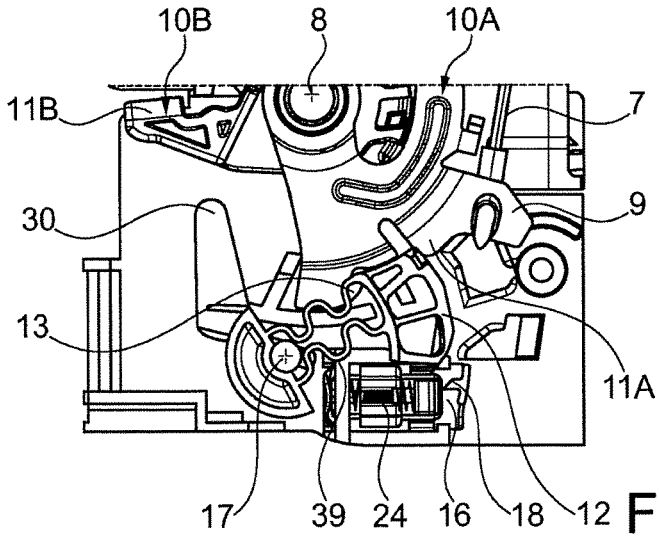

According to the embodiment represented in FIG. 6*c*, the blocking means 12 is housed in the reinforcement of the protuberance 11*b* and blocks the opening lever 10A. The outer opening lever 10A is accordingly stopped in the rotation that it had started to perform by the blocking means 12. The protuberance 30 remains spaced from the two opening levers 10A and 10B.

If the shock 3 induces oscillations tending to pivot the outer opening lever 10A in the direction of the opening of the door leaf 2, said oscillations typically have an intensity lower than the stiffness of the elastic arms 39, if the blocking means 12 includes them, in any case, than the stiffness of the elastic return means 14, so that the blocking means 12 remains in the blocking position.

Figure 6D:
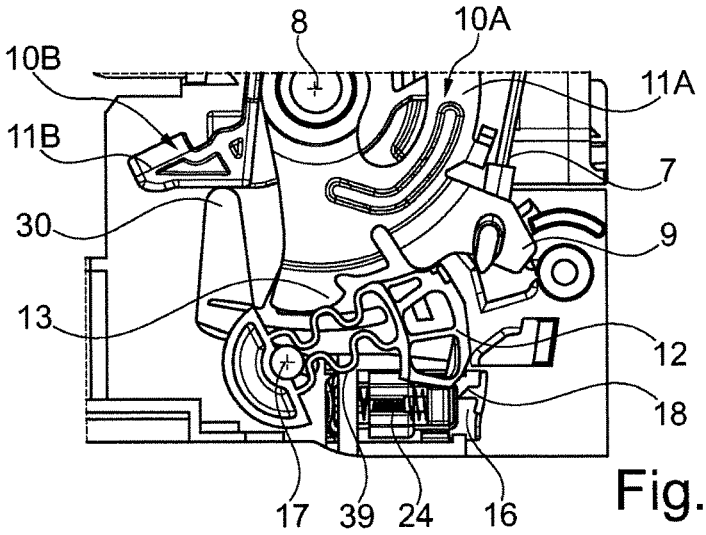

According to the embodiment of FIG. 6*d*, as soon as the acceleration becomes zero, the trigger means 16 returns under the effect of its elastic return means 24 into the rest position.

In order to disengage the blocking means 12 from the blocking position thereof and to bring it back to the rest position in the trigger 16, an action, such as a traction, is imposed to the control means 13 of the intermediate opening lever 10B. Thus, the cam 11B pivots about its axis of rotation 8 and bears on the protuberance 30.

Figure 6E:
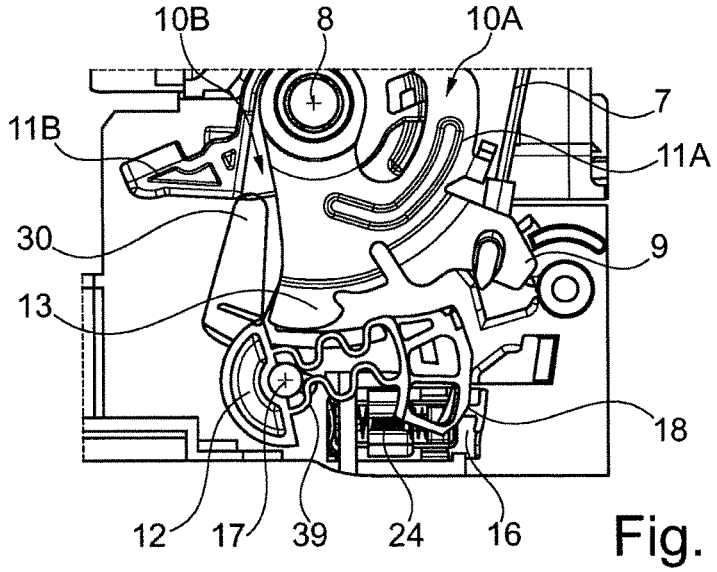

As represented in FIG. 6*e*, the protuberance 30 follows the profile of the cam which causes the rotation of the blocking means 12 towards the rest position in the trigger means 16. The holding protuberance 18 of the trigger means gets into the notch 20 of the blocking means.

Figure 6F:
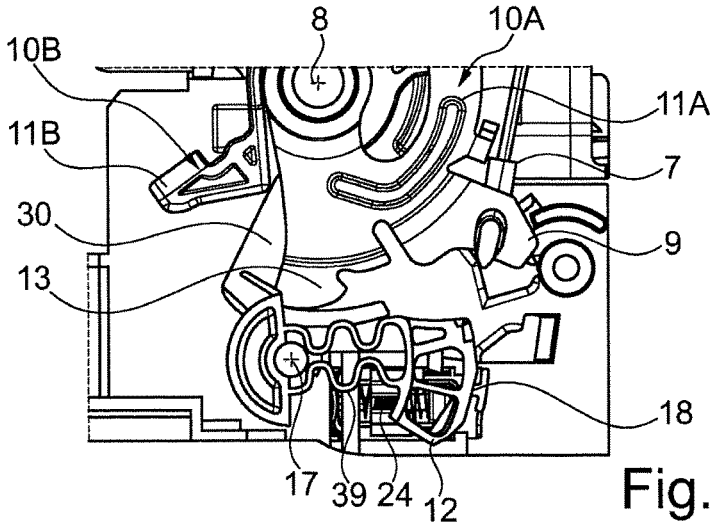

As represented in FIG. 6*f*, the blocking means 12 is in the rest position thereof, as well as the trigger means 16 which blocks the blocking means via the stop 18.

Thus, advantageously, the latch of the invention includes a phase in which the triggering member which releases the blocking means member is triggered under the impulse of an inertial effort, a blocking principle, which prevents the opening by blocking the outer opening lever and a principle of resetting in the rest position by actuating the inner handle.

Furthermore, the invention allows putting the blocking means in torsion or in moment in order to prevent the seizure of the blocking device of the levers.

The latch of the invention has the following advantages:

the blocking of the opening in case of traction on the outer opening lever cable upon an inertial shock with a blocking device independent of the environment of the latch, the blocking of the kinematic chain of the latch made within the latch by avoiding any interaction with members present in the door leaf, the triggering under the inertial effect resulting from a shock or not, the triggering being performed from an inertial effort threshold which is determined by the stiffness selected from the elastic return means of the blocking means and the trigger means, the displacement time of the blocking means is constant since it depends on the elastic return means whose stiffness may be selected as a function of the desired displacement time, the positioning of the blocking means and the trigger means has a high tolerance because the blocking is carried out by contact on zones which allows avoiding the manufacturing clearances;

the resetting in the rest position is performed in a simple and reliable manner by an additional effort achievable by a user on the inner handle, the volume of the support on which the blocking means and the trigger are fastened is reduced which also allows reducing the manufacturing cost.

The invention claimed is:

1. A latch for a motor vehicle door leaf comprising:

a set of control means, each control means being movable;

a set of opening levers of said door leaf, each lever being configured to allow the opening of the door leaf by a control means of the set of control means, each lever comprising a cam movable in rotation about an axis of rotation and fastened to said control means at a fastening zone to be driven in rotation during the displacement of the control means;

a blocking means configured to take an active blocking position in which said blocking means blocks an opening lever of the set of opening levers and a rest position in which said blocking means authorizes the movement of each opening lever, an elastic return blocking means configured to switch said blocking means from the rest position to the active blocking position; and a trigger means configured to take a rest position in which said trigger means blocks the blocking means in the rest position thereof and an active unblocking position in which said trigger releases said blocking means so that said blocking means switches from the rest position to the active blocking position, wherein the blocking means and one opening lever of the set of opening levers unblocked by the blocking means in the blocking position cooperate to bring the blocking means from the active blocking position to the rest position when said unblocked opening lever pivots towards the direction of the opening of the door leaf.

2. The latch according to claim 1, wherein the blocking means and the opening lever that are not to be blocked cooperate by the contact with a protuberance belonging to the blocking means or to one of the set of opening levers on the cam of the one opening lever that is not to be blocked.

3. The latch according to claim 1, wherein the blocking means and the opening lever that is not to be blocked cooperate by the contact with a protuberance belonging to a distinct part of the blocking means or of the set of opening levers.

4. The latch according to claim 1, wherein the elastic return blocking means includes a first end capable of coming under a stop belonging to the blocking means and a second end capable of being fastened on a fixed member of the latch.

5. The latch according to claim 1, wherein the blocking means includes an elastic lug abutting against a fixed member of the latch and intended to exert a return force on the blocking means when said blocking means is in the active blocking position.

6. The latch according to claim 1, wherein the trigger means is associated to an elastic return unblocking means configured to allow the switch of the trigger means from the rest position to the active unblocking position.

7. The latch according to claim 1, wherein the trigger means is movable in translation thanks to the elastic return means, such as a compression spring, fastened to the trigger means and to a fixed member of the latch.

8. The latch according to claim 1, wherein the trigger means includes a protuberance being substantially in or on a complementary notch present in the blocking means.

9. The latch according to claim 1, wherein the blocking means is disposed in the latch in the rest position such that at each rotation of the opening leverin the direction of the opening of the door leaf and when the blocking means is in the rest position, the blocking means and the opening lever come into contact.

10. The latch according to claim 1, wherein the cam of one of the set of the opening levers to be blocked includes a hook-type protuberance, formed by a stop of a structure defining a reinforcement configured to receive a portion of a blocking means when said blocking means portion is in the active blocking position to block the movement of the opening lever to be blocked.

11. The latch according to claim 10, wherein the blocking means includes a ramp allowing the elastic return blocking means to return under the stop when said blocking means switches from the active blocking position to the rest position.

12. The latch according to claim 11, wherein the protuberance is configured to receive the end of the elastic return blocking means and to drive said end under the stop of the blocking means when the blocking means has been brought into the rest position.

13. The latch according to claim 1, wherein the blocking means includes at least one elastic arm configured to modify the length of the blocking means in order to allow disengaging the elastic return blocking means relative to the blocking means when the blocking means switches from the active blocking position to the rest position.

14. The latch according to claim 1, wherein the opening lever intended to be blocked is an outer opening lever configured to be driven by a control means of the set of control means controlled by a handle external to the motor vehicle and the opening lever intended not to be blocked is an intermediate opening lever configured to be driven by a control means of the set of control means controlled by a handle internal to the motor vehicle.

15. A motor vehicle including a door leaf and a latch intended to open and close said door leaf according to claim 1.

* * * * *